United States Patent [19]

Salomon et al.

[11] Patent Number: 4,534,123

[45] Date of Patent: Aug. 13, 1985

[54] CROSS-COUNTRY OR TOURING SKI BOOT AND METHOD OF MANUFACTURE

[75] Inventors: Georges P. J. Salomon, Annecy; Jean-Paul Vinay, Roybon, both of France

[73] Assignee: Salomon S.A., Annecy, France

[21] Appl. No.: 344,943

[22] Filed: Feb. 2, 1982

[30] Foreign Application Priority Data

Feb. 6, 1981 [FR] France ..... 81 02728

[51] Int. Cl.[3] ..... A43B 13/14; A43B 5/04; A43B 5/16

[52] U.S. Cl. ..... 36/99; 36/119; 36/117

[58] Field of Search ..... 36/43, 55, 57, 99, 117, 36/119, 92, 77 R, 68

[56] References Cited

U.S. PATENT DOCUMENTS

| | | | |
|---|---|---|---|
| 2,235,490 | 3/1941 | Saksa | 36/89 X |
| 2,601,162 | 6/1952 | McLaughlin | 36/77 R |
| 3,396,479 | 8/1968 | Primak | 36/99 |
| 3,530,596 | 9/1970 | Kaufmann et al. | 36/99 |
| 3,795,991 | 3/1974 | Borjesson | 36/117 |
| 3,875,687 | 4/1975 | Henderson | 36/7.1 R |
| 4,067,126 | 1/1978 | Bergeron et al. | 36/45 X |
| 4,259,791 | 4/1981 | Bazan | 36/117 X |

FOREIGN PATENT DOCUMENTS

| | | | |
|---|---|---|---|
| 886108 | 8/1953 | Fed. Rep. of Germany . | |
| 1006261 | 2/1952 | France . | |
| 1145907 | 10/1957 | France | 36/117 |
| 2119653 | 8/1972 | France . | |
| 2484799 | 12/1981 | France | 36/117 |
| 446123 | 5/1949 | Italy | 36/117 |
| 321074 | 6/1957 | Switzerland | 36/119 |
| 425532 | 5/1967 | Switzerland . | |

*Primary Examiner*—Werner H. Schroeder
*Assistant Examiner*—T. G. Graveline
*Attorney, Agent, or Firm*—Sandler & Greenblum

[57] ABSTRACT

A boot includes a first upper having a vamp and a quarter, and a second upper having a vamp and a quarter. The first upper is adapted to encase a wearer's foot; the second upper encases the first upper, and extends upwardly to secure the base of the leg. The first and second uppers are secured to a sole of the boot. A process for forming such a boot includes the steps of:

(a) superimposing the second upper over the first upper;

(b) stitching the quarter of said second upper on the vamp of said first upper, the stitching realized being offset from the stitching of the reinforcement tip of said second upper;

(c) positioning respectively a hard reinforcement cap between the reinforcement tip and the wall of the vamp of said first upper at the front of the boot, and a stifener of counter at the rear of the boot;

(d) lasting the two superimposed second and first uppers together on an insole;

(e) securing an outer sole to the bottom of said boot being lasted on said insole, so as to have said vamp of first upper and said reinforcement tip of second upper extending to between said insole and outer sole.

36 Claims, 9 Drawing Figures

CROSS-COUNTRY OR TOURING SKI BOOT AND METHOD OF MANUFACTURE

BACKGROUND OF THE INVENTION

1. Field of the Invention

The invention relates to a shoe or boot for use in sports, and particularly in skiing, of the type having a double upper, and to a method used to manufacture such a shoe. More particularly, the invention provides improved boots adapted essentially for cross-country skiing, touring, mountaineering skiing, and off-trail skiing.

2. Description of Prior Art

Boots used in cross-country skiing and the like differ from competition cross-country ski boots in that they are provided with extended uppers which serve to better protect the skier against entry of cold air and snow. The various models of downhill ski boots having extended uppers on the market comprise extended uppers which are made either of leather, or out of molded rubber and are laced on top of the foot. The extended uppers further comprise applied reinforcement elements which are pieces of leather sewn to the exterior of the uppers. Furthermore, boots having extending uppers are provided, in the middle of the malleoli, or ankle bones, with padding sections which are stitched to the corresponding edge of the upper such that they form a sealing bead. Generally, such boots are lined with a foam layer or fur, which may or may not be synthetic, so as to ensure the comfort of the foot in the boot.

Where the boot uppers are made out of molded rubber, the boots are extremely heavy and uncomfortable by virtue of the formation of hard folds or wrinkles during flexion in the metatarsal zone, for example. Furthermore, such boots provide very little thermal insulation as a result of the very nature of the rubber, despite the intenal fur lining. Finally, as in many cross-country ski boots having extended uppers or shafts made of leather or a synthetic material, such boots are provided with stitching of the reinforcement, padding, and/or decoration sections which are transverse stitches. The permeability of such stitching during passage through deep and/or wet snow adds to the inconvenience of their relatively high weight.

Other solutions to moisture and temperature penetration problems have been provided in certain double-upper mountain boots. Unfortunately, these solutions cannot be adapted to cross-country ski boots which manufacturers are presently prepared to manufacture, and which combine strength, comfort and lightness. In effect, the technique of forming such mountain boots having a double upper requires the use of high-quality materials, such as leather, which have material thicknesses which limit the possibility of shaping them, and which themselves add to the weight of the boot. Furthermore, known techniques of assembling such boots include a series of manual operational steps which are relatively substantial both with respect to the overall amount of time which they require as well as the substantial number of individual manufacturing operations, which further increases the costs of manufacture and handling.

SUMMARY OF THE INVENTION

It is an object of the present invention to overcome the above disadvantages, and to provide a cross-country ski boot having an extended upper for touring and/or off-trail skiing which is easy to manufacture, and which, nevertheless, securely holds the foot, is comfortable to the wearer, and is wear-resistant and light.

The invention provides a process for manufacturing a cross-country ski boot which comprises, according to one aspect of the invention, a double upper encasing the foot and an outer sole which is secured to the double upper.

The boot is formed of a first upper adapted to surround the foot of the skier; and a second upper which is adapted to extend over the base of the leg when it is inserted in the first upper. The first upper comprises two quarters. The second upper comprises a single slipper having a vamp and quarter. Prior to attaching the first and second uppers, the second upper is provided with reinforcements, with a rod, and with a collar stitched over the top of the quarters, while the quarters have an end edge, known as a "stitching grip" or as an underlay in the art, which is recessed from the edge of the reinforcement tip, attached to the front of the quarters. The reinforcement tip is called a "double" or "backer".

According to the process of the invention, the quarter of the second upper is sewn to the vamp of the first upper placed within the second upper such that the stitching on the stitching grip is offset with respect to the stitching of the reinforcement tip. Furthermore, according to the process, a hard end cap is then inserted between the reinforcement tip and the wall of the quarter of the second upper which is at least partially coextensive with the vamp of the first upper and, in a fashion known in and of itself, a reinforcement is positioned between the top and the lining of the heel zone of the internal upper.

The boot is then assembled by mounting the entire assembly of the two reinforced uppers, which have been previously sewn to one another, and the nested assembly. The assembly of the boot is completed by gluing the sole on the double upper, which has been previously assembled.

By virtue of the assembly technique, it is possible to assemble two uppers on the inner sole. The offset arrangement of the assembly stitches between the internal upper and the external upper considerably improves the sealing of the walls of the boot, which is adapted to move through snow, and increases the resistance to rupture of the sewn portions, which are no longer subjected to the disadvantage of vamping on the flat, which localizes transverse stitches in a common assembly zone having a plurality of secured walls which can loosen all at once.

According to one preferred embodiment of the invention, the cross-country ski boot which is thus formed is composed of a double upper assembled as explained above, and welded i.e., glued in an industrial fashion, to a sole which is adapted to cooperate and be used with conventionally available corresponding cross-country ski bindings.

Preferably, the first or interior upper is of the "low-upper" type whose side edges are cut beneath the malleoli, as are the uppers of conventionally available sports or training boots which encase and tightly, but comfortably, maintain the foot, while the second or external upper is composed of an assembly upper which, as is required for cross-country skiing, encases the base of the leg inserted in the first interior upper up to above the ankles.

BRIEF DESCRIPTION OF DRAWINGS

One embodiment of the invention is described with reference to the annexed drawings, by way of example only, in which.

DESCRIPTION OF PREFERRED EMBODIMENTS

Figure 1:
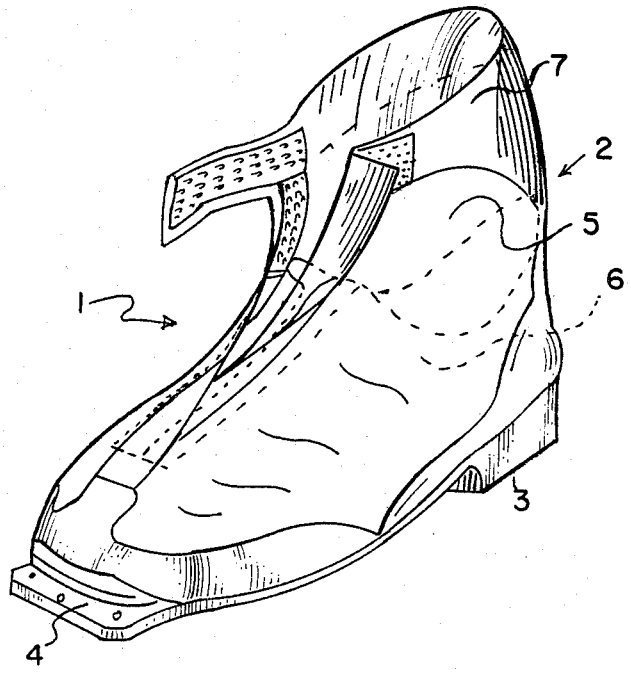
FIG. 1 is a perspective view of a cross-country ski boot according to the invention.

FIG. 1 generally illustrates a cross-country type ski boot according to the invention without specifying the particular mode of cooperation between the boot and any of the corresponding bindings which are presently commercially available. Thus, for example, the process of the invention can be used to manufacture a variety of boots; e.g., a boot provided with a latching ring element, such as is disclosed in U.S. application Ser. No. 103,066 now U.S. Pat. No. 4,334,367.

Figure 9:
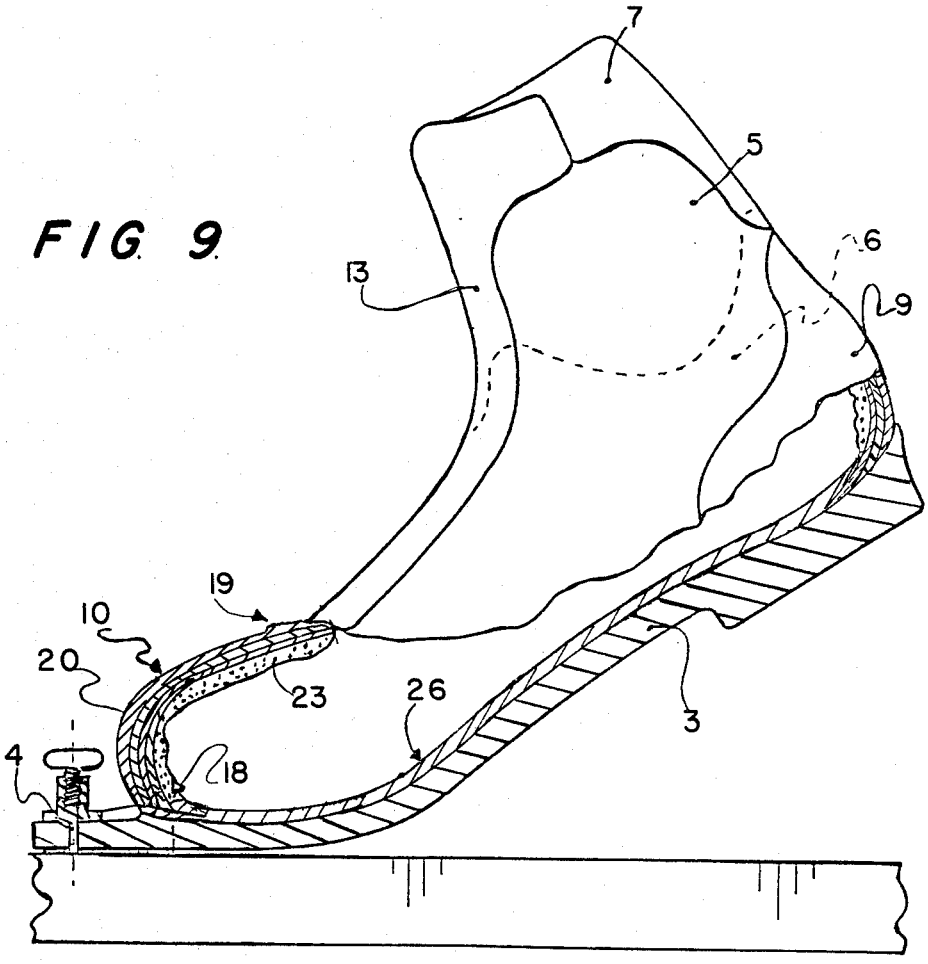
FIG. 9 shows the boot attached to a cross-country ski binding.

The Figure illustrates a cross-country ski boot 1 comprising an upper 2 along its exterior mounted on an outer or walking sole 3, which is adapted to cooperate at its toe 4 with a cross-country ski binding as seen in FIG. 9.

As may be seen from the remaining Figures, the upper 2 of the boot is in fact a "double upper", and this term will be used to characterize the upper hereinafter. Double upper 2 is mounted on sole 3 and is in fact made up of an upwardly-extending external or second upper 5 and a lower internal or first upper 6, which are both joined simultaneously to an insole by tacks and/or a weld during the process of manufacture, as will be explained below.

External upper 5 extends upwardly above at least the ankle zone and surrounds the base of the leg by means of a collar 7 made of an elastic foam material which provides a good padding and a rim, whose flexibility guarantees both leg comfort at the contact zone with the leg and a seal against the entry of snow and cold. Synthetic flexible materials of low thickness, but which exhibit good mechanical resistance, are used to form quarters 8 of external upper 5 because of their light weight and their ease of manipulation during assembly. Furthermore, it should be noted that polyurethane-coated leather reinforcements 9 and 10 having a good resistance to abrasion are secured to the quarter 8 of this upper beginning at end 11 and extending over the entire lower edge 12 of the quarter. An opening is provided along the front of the boot, and is preferbly provided with a closure system 13, which may be of the "VELCRO" type, and which can be easily manipulated.

Figure 6:
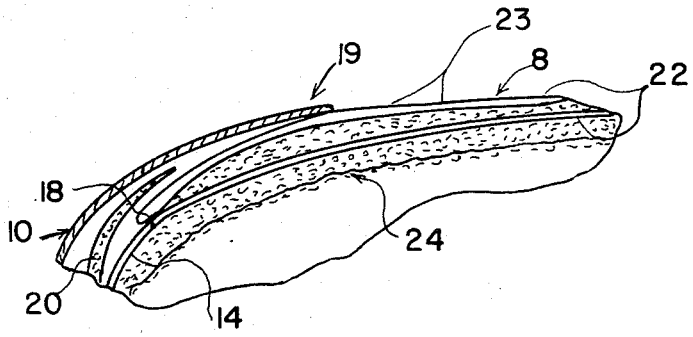
FIG. 6 is a cross-sectional view in the front zone at the boot which highlights the offset of the assembly stitches between the walls of the first and second uppers.

Internal upper 6 comprises a single piece or slipper 14, which can be of the same material as the external upper, i.e., Nylon 22 material which has been treated so as to be sealed over the exterior surface. Piece 14 comprises a vamp and quarter. The internal upper is lined with a Polyester 23 foam layer, on which is applied a brushed velour 24 made of a nylon fabric or netting on the interior of the boot (FIG. 6). Piece 14 is sewn to the rear of the heel with a reinforcement rod 15, according to a technique which is known in the art, (called a back-strap) and the only additional reinforcement provided on the internal upper, which is very supple by virtue of the nature of the materials utilized, is the lacing reinforcement 16, which is positioned on both sides of the foot insertion opening 17. One thus provides, in effect, a type of slipper, which holds the foot in a manner which is appropriate for cross-country skiing, and whose seal and comfort is assured by the external upper.

The principal steps of the process of manufacturing the cross-country ski boot according to the invention are respectively shown by FIGS. 2–8.

Figure 2:
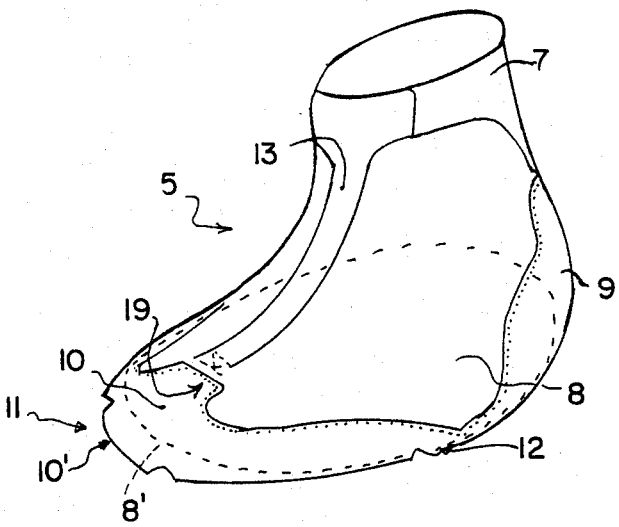
FIG. 2 is a perspective view of the second or external upper of the cross-country ski boot formed according to the process of the invention.

FIG. 2 illustrates external upper 5 after it has been formed by stitching (according to known shoe-manufacturing techniques), rear reinforcement 9, front reinforcement 10, collar 7 and a closure system 13 on the exterior quarter 8 made of nylon fabric coated as has been described above. According to one aspect of the inventive process, it should be noted that the reinforcement 10 has an edge periphery 10' which is greater than that of the stitching grip 8' of the quarter on which it is sewn.

Figure 3:
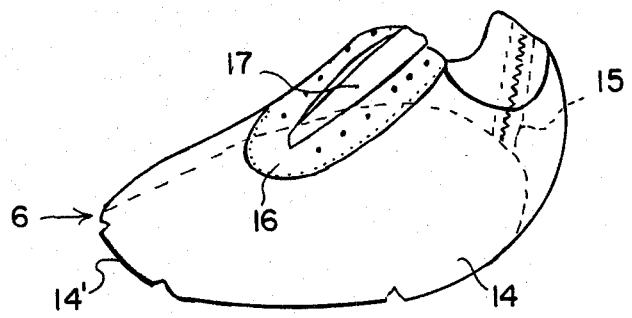
FIG. 3 is a perspective view of the lower internal or first upper.
Figure 4:
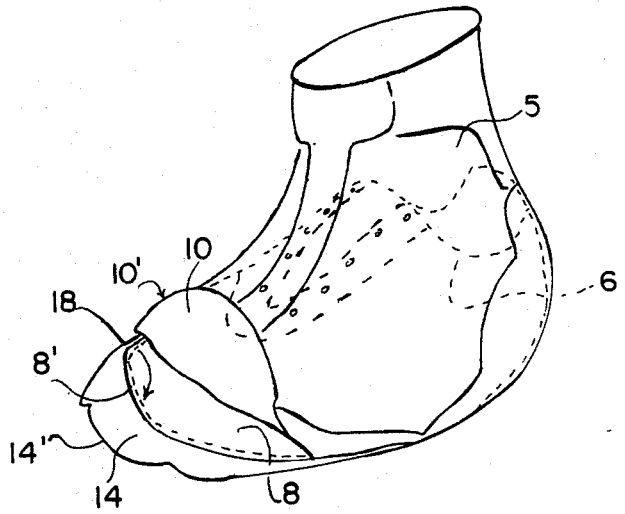
FIGS. 4 and 5 illustrate, in perspective and in side view, respectively, the assembly of the first (internal) and second (external) uppers assembled according to the process of manufacturing a cross-country ski boot according to the invention.
Figure 5:
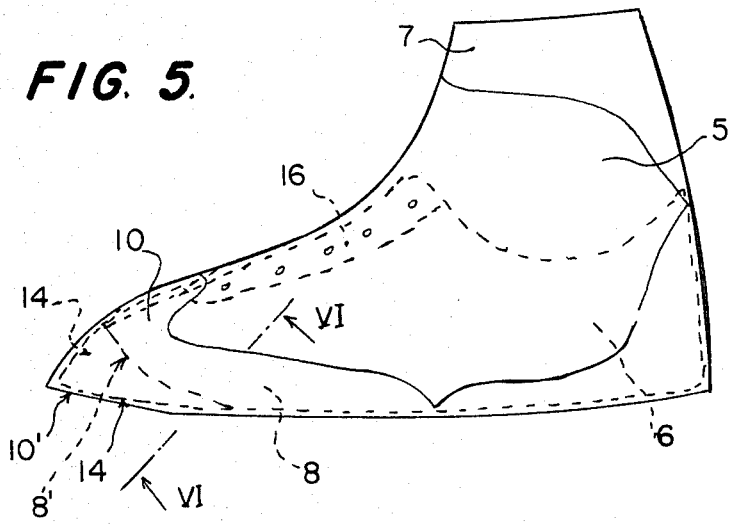

FIG. 3 illustrates internal upper 6 after it has been formed according to the method of manufacture. This upper is the same as that on the external upper, except that it does not comprise tip reinforcements, and in that it is provided with a single reinforcement rod 15 on the rear of the heel, as well as lacing reinforcements 16. The two uppers are superimposed, as shown in FIGS. 4 and 5, with external upper 5 being superimposed on internal upper 6. The elements are stitched together by stitching 18 in the zone of the stitching grip 8' of external quarter 8 onto internal sliper 14 of internal upper 6 such that stitching 18 is recessed from edge 14' of internal slipper 14, to which edge 10' of end reinforcement tip 10 of external upper 5 corresponds. One thus achieves, as is shown in FIGS. 5 and 6, an offset between the various vamp stitchings 18 and 19 of the two uppers 5 and 6, which results in an improved sealing of the walls of boot 1, as well as improved wear resistance.

In a manner known in and of itself, the edges are glued, after carding and/or trimming, to the insole on a form, having taken care to glue this insole. These latter operations are not described in detail, and are conventional in the shoe industry.

FIG. 6 illustrates one aspects of the invention, in which hard end cap 20 is positioned between reinforcement tip 10 and internal vamp 14 during the gluing-and-assembly phase of the process. Cap 20 is made of thermoplastic material, which is molded or solvent-polymerized. External quarter 8 is secured onto internal vamp 14. At the same time, support 21 is positioned between the polyester foam lining and the coated nylon fabric of the internal upper according to a technique which is conventionally employed in boots, and which, therefore, need not be particularly described. Support 21 is a stiffener or counter positioned between the rear wall of slippper 14 and foam layer 23 as seen in FIG. 7, to prevent sagging of the upper.

Figure 7:
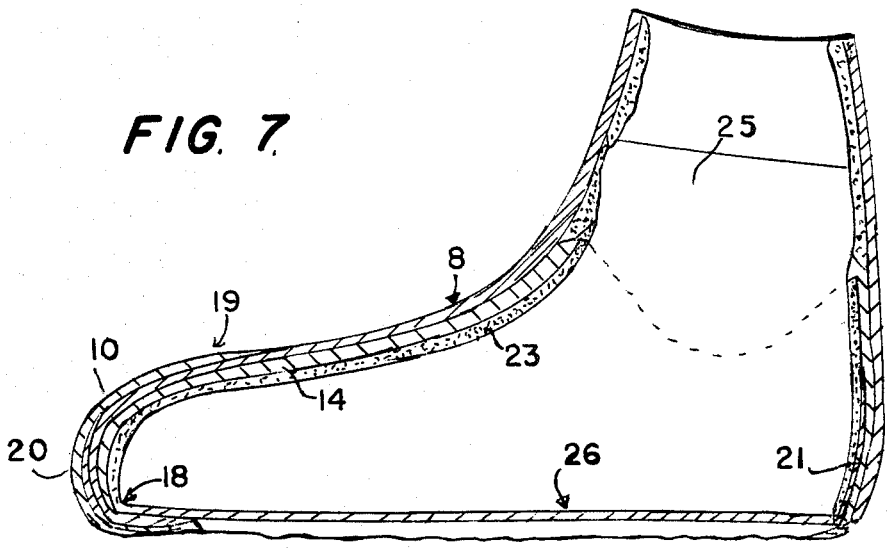
FIGS. 7 and 8 illustrate cross-sectional views of one side of the boot according to the invention, respectively, after assembly of the tip and the reinforcement of the upper, and after mounting of the outer sole by gluing.

Next, the end of the boot is assembled, as is illustrated in FIG. 7, by mounting double upper 2 on form 25, on which an outer sole 26 was previously attached. This step is performed by simultaneously feeding the machine with the reinforcement tip, the hard cap, and the edge of the internal upper, on which the stitching grip of the external upper is sewn. FIG. 7 likewise illustrates the boot in the course of manufacture of the rear portion, provided with support 21, after the assembly of the nesting wherein the nesting is tacked to improve the grip.

Figure 8:
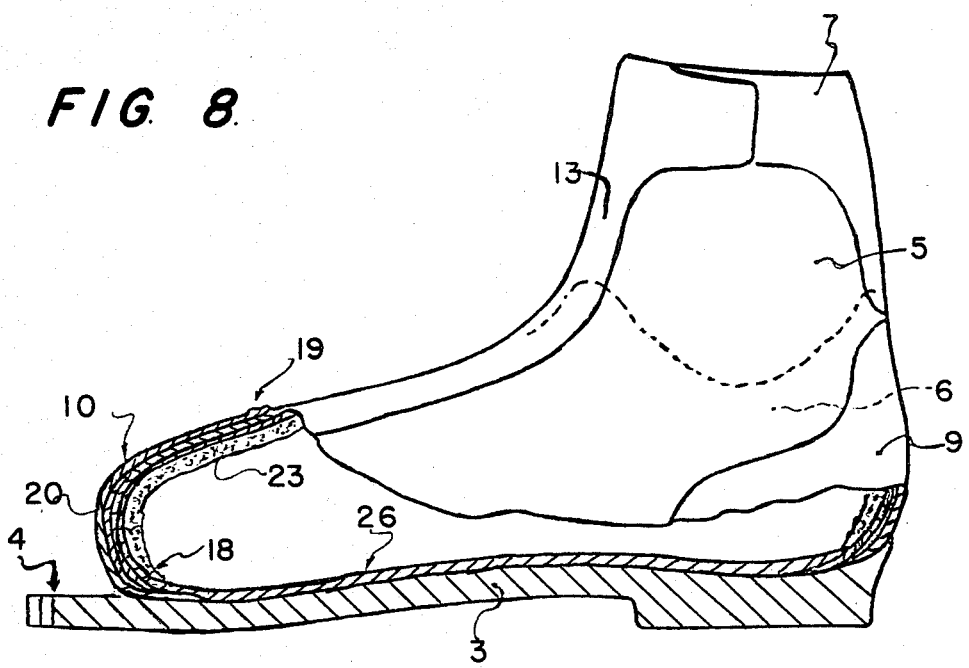

FIG. 8 illustrates the boot in partial cross-section, after the outer sole 3 has been welded on double upper 2, formed during the step illustrated in FIG. 7. Quite obviously, certain carding or gluing steps have not been illustrated, since they are well known to those in the shoe industry.

Likewise, it is clear that the invention, and more particularly the vamping process, which is an object of an essential characteristic of the invention, is not limited to application in connection with cross-country ski boots, but relates to all boots where strength, sealing and lightness are the desired qualities, such as in sports shoes and boots, mountain boots, training boots etc.

Furthermore, it will be understood that the external upper of such boots is not limited to boots having an opening along the front of the foot, and that the opening/closing could as well be situated in the rear or on the sides of the external upper.

Although the invention has been described with reference to particular materials, means and configurations, it is to be understood that the invention is not limited to the particulars disclosed and extends to all alternatives and equivalents within the scope of the claims.

What is claimed is:

1. A boot for housing a leg and a foot of a wearer having a malleoli, wherein said boot comprises a first upper having a vamp and a second upper having a quarter, said first upper being adapted to encase the foot only below the malleoli of the wearer, said second upper encasing said first upper and extending upwardly to secure the base of the leg, said first and second uppers being secured to a sole of said boot, wherein said quarter of said second upper is stitched to said vamp of said first upper.

2. The boot as defined by claim 1 wherein said boot is adapted to house a heel of a foot of a wearer, wherein said first upper comprises a reinforcement rod positioned at the rear of said first upper at a position corresponding to the heel of the foot of the wearer.

3. The boot as defined by claim 1 wherein said second upper comprises a reinforcement tip for reinforcing the front of said boot.

4. The boot as defined by claim 3 wherein said quarter has a front portion and wherein said reinforcement tip is attached to said front portion of said quarter.

5. The boot as defined by claim 4 wherein said reinforcement tip is stitched to said second upper at a position offset from the stitching of said quarter of said second upper to said vamp of said first upper.

6. The boot as defined by claim 3 wherein said sole comprises an insole and an outer sole and whereby said vamp of first upper and said reinforcement tip extend to between said (insole) and outer sole.

7. The boot as defined by claim 6 further comprising a hard reinforcement cap positioned at the front of said boot, said reinforcement cap being positioned between said quarter of said second upper and said reinforcement tip.

8. The boot as defined by claim 7 further comprising reinforcement means, at the rear of said boot.

9. The boot as defined by claim 8 wherein said reinforcement means comprises a reinforcement rod.

10. The boot as defined by claim 7 wherein said first upper comprises a heel and said heel of said first upper comprises a support.

11. The boot as defined by claim 10 wherein said first upper comprises a lining and said support is positioned between said lining and said second upper.

12. The boot as defined by claim 1 wherein said boot is a ski boot having a heel, said sole is an outer sole comprising a front extension adapted to be secured to a ski by a ski binding in a manner so as to allow the heel of said boot to be lifted off said ski.

13. The boot as defined by claim 1 wherein said wearer has a malleoli and wherein the upper edges of said first upper are adapted to pass beneath the malleoli of the wearer while said second upper extends upwardly beyond said malleoli.

14. The boot as defined by claim 1 wherein said first upper comprises lacing means for lacing said first upper closed around the foot.

15. The boot as defined by claim 1 or 14 wherein said second upper comprises VELCRO fastening means for securing said second upper around the leg.

16. The boot as defined by claim 1 wherein said first upper is formed of a rigid material and second upper is formed of a flexible and elastic material.

17. A boot for housing a foot of a wearer comprising:

(a) means for housing the upper portion of said foot;

(b) means for encasing said housing means, comprising:

(i) a quarter having a front portion portion; and (ii) a reinforcement tip, connected to said front portion of said quarter, wherein said encasing means is attached to said housing means at a position offset from the connection between said reinforcement tip and said quarter.

18. The boot as defined by claim 17 wherein said boot further comprises a sole to which said housing and said encasing means are secured.

19. The boot as defined by claim 18 wherein said wearer has a malleoli, and wherein said housing means extends below said malleoli of the wearer, and said encasing means extends above said malleoli of the wearer.

20. The boot defined by claim 17 wherein said housing means is a first upper and said encasing means is a second upper.

21. The boot as defined by claim 20 wherein said foot of the wearer has a heel and said first upper comprises a reinforcement rod, positioned at the rear of said first upper at a position corresponding to the heel of the foot.

22. The boot as defined by claim 20 wherein said boot has a front portion and said second upper comprises a reinforcement tip for reinforcing the front portion of said boot.

23. The boot as defined by claim 23 wherein said second upper comprises a quarter having a front portion and said reinforcement tip extends beyond said front portion of said quarter of said second upper.

24. The boot as defined by claim 23 wherein said first upper comprises a vamp and said quarter of said second upper is stitched to said vamp of said first upper.

25. The boot as defined by claim 24 wherein said reinforcement tip is stitched to said second upper at a position offset from the stitching of said quarter of said second upper to said vamp of said first upper.

26. The boot as defined by claim 20 wherein said boot further comprises a sole having an insole and an outer sole and wherein said vamp of first upper and said reinforcement tip extend to between said insole and outer sole.

27. The boot as defined by claim 26 further comprising a hard reinforcement cap positioned at the front of said boot, said reinforcement cap being positioned between said quarter of said second upper and said reinforcement tip.

28. The boot as defined by claim 27 further comprising reinforcement means at the rear of said boot.

29. The boot as defined by claim 28 wherein said reinforcement means comprises a reinforcement rod.

30. The boot as defined by claim 27 wherein said first upper comprises a heel and said heel of said first upper comprises a support.

31. The boot as defined by claim 30 wherein said first upper further comprises a lining and said support is positioned between said lining and said second upper.

32. The boot as defined by claim 20 wherein said boot is a ski boot, which further comprises an outer sole comprising a front extension adapted to be secured to a ski by a ski binding in a manner so as to allow the heel of said boot to be lifted off said ski.

33. The boot as defined by claim 20 wherein the wearer has leg having a malleoli and the upper edges of said first upper are adapted to pass beneath the malleoli of the wearer while said second upper extends upwardly beyond said malleoli.

34. The boot as defined by claim 20 wherein said first upper comprises lacing means for lacing said first upper closed around the foot.

35. The boot as defined by claim 34 wherein the wearer has a leg and said second upper comprises VELCRO fastening means for securing said second upper around the leg.

36. The boot as defined by claim 20 wherein said first upper is formed of a rigid material and second upper is formed of a flexible and elastic material.

* * * * *